United States Patent [19]

Nakajima et al.

[11] Patent Number: 4,875,835

[45] Date of Patent: Oct. 24, 1989

[54] VARIABLE DISPLACEMENT COMPRESSOR

[75] Inventors: Nobuyuki Nakajima; Kenichi Inomata; Masaya Moruta; Toshio Yamaguchi; Kazuo Eitai, all of Konan, Japan

[73] Assignee: Diesel Kiki Co., Ltd., Tokyo, Japan

[21] Appl. No.: 271,303

[22] Filed: Nov. 15, 1988

[30] Foreign Application Priority Data

Dec. 24, 1987 [JP] Japan ..... 62-327658

[51] Int. Cl.[4] ..... F04B 49/02; F04C 29/08

[52] U.S. Cl. ..... 417/295; 417/310

[58] Field of Search ..... 417/295, 310

[56] References Cited

U.S. PATENT DOCUMENTS 4,726,740 2/1988 Suzuki et al. ..... 417/310

4,744,732 5/1988 Nakajima et al. ..... 418/15

*Primary Examiner*—William L. Freeh

*Attorney, Agent, or Firm*—Wenderoth, Lind & Ponack

[57] ABSTRACT

A variable displacement compressor includes a lubrication oil supply passage defined in a side block for interconnecting a displacement adjustment mechanism disposed in the side block and a high pressure oil sump defined in the side block. With this lubrication oil supply passage, a sufficient lubrication of the displacement adjustment mechanism is achieved.

4 Claims, 4 Drawing Sheets

VARIABLE DISPLACEMENT COMPRESSOR

BACKGROUND OF THE INVENTION

1. Field of the Invention

The present invention relates to a variable displacement compressor suitable for use in an automobile air conditioning system, for example, and so constructed as to compress a refrigeration medium or the like working fluid and adjustably displace the thus compressed refrigeration medium.

2. Description of the Related Art

A typical example of variable displacement compressors of the type described is disclosed in Japanese Patent Laid-open Publication No. 62-157291. The disclosed variable displacement compressor includes a cylinder and a rotor rotatably received in the cylinder and carrying thereon a plurality of radially movable sliding vanes. Front and rear side blocks are disposed at opposite ends of the cylinder so as to define between the cylinder, rotor, vanes and side blocks a plurality of compression chambers. The front side block is provided with a displacement adjustment mechanism for controlling the amount of refrigeration medium to be withdrawn for compression from intake holes into the compression chambers, thereby adjusting the displacement of the compressor according to various operating conditions of the compressor.

The displacement adjustment mechanism may be provided on the rear side of the compressor in which instance the front side block is formed with a lubrication oil passageway for lubrication of the displacement adjustment mechanism. The lubrication oil passageway opens at its opposite ends to a high pressure oil sump and to an end face of the rotor. In operation, the lubrication oil is fed to flow out from a clearance between the front side block and the rotor, then lubricates a bearing supporting a shaft, and flows through a longitudinal central groove in the shaft to the rear side of the cylinder. Thereafter, the lubrication oil flows into a bearing and the displacement adjustment mechanism for lubricating the same.

With this construction, the lubrication oil is subjected to a succession of choking actions or flow resistances as it flows through a long flow path to the displacement adjustment mechanism, and hence a sufficient supply of lubrication oil is difficult to obtain. This insufficient lubrication oil supply is likely to cause seizing of sliding surfaces of moving parts due to the shortage of lubrication oil.

SUMMARY OF THE INVENTION

It is accordingly an object of the present invention to provide a variable displacement compressor incorporating structural features which enables a lubrication oil to be sufficiently supplied to a displacement adjustment mechanism.

Another object of the present invention is to provide a variable displacement compressor capable of supplying a high pressure lubrication oil to a displacement adjustment mechanism through a relatively short lubrication oil passageway.

A further object of the present invention is to provide a variable displacement compressor in which a displacement adjustment mechanism and a bearing supporting a shaft are lubricated independently of each other.

According to the present invention, there is provided a variable displacement compressor having a rotor carrying thereon a plurality of radially movable sliding vanes and rotatably disposed in a space defined jointly by and between a cylinder and a pair of side blocks connected to opposite ends of the cylinder. The cylinder, the rotor, the side blocks and the vanes jointly define therebetween a plurality of compression chambers which vary in volume with each revolution of the rotor. A pair of heads are attached to the pair of side blocks, respectively. A displacement adjustment mechanism is incorporated in one of the side blocks and one of the heads which is attached to the one side block, for controlling the compression starting timing in the compression chambers. The side block one a first oil sump for retaining therein a lubrication oil, the cylinder having a connection passage extending between the first oil sump and a second oil sump defined at a high pressure side of the compressor for maintaining the first oil sump under a highly pressurized condition. The side block further has a lubrication oil supply passage interconnecting the first oil sump and the displacement adjustment mechanism.

With this construction, the high pressure lubrication oil is supplied from the first oil sump to the displacement adjustment mechanism through the lubrication oil supply passage. Since this lubrication oil supply passage is short and hence exerts only a low flow resistance on the lubrication oil, the lubrication oil is supplied sufficiently to the bearing portions and the displacement adjustment mechanism.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
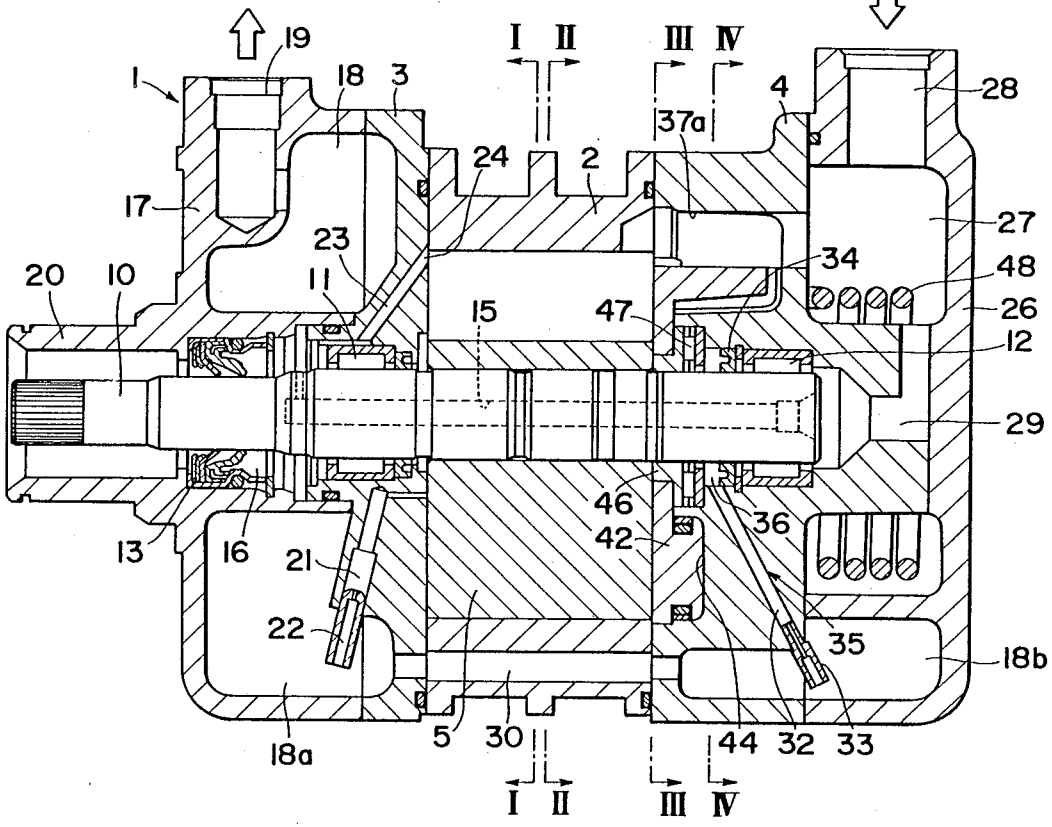
FIG. 1 is a longitudinal cross-sectional view of a variable displacement compressor according to the present invention.

A preferred embodiment of the present invention will be described hereinbelow in detail with reference to the accompanying drawings.

As shown in FIGS. 1 through 5, a variable displacement compressor embodying the present invention comprises a sliding-vane rotary compressor 1 including a cylinder 2 having a substantially elliptical bore defined by an inner peripheral surface of the cylinder 2. The cylinder 2 is closed at its opposite ends by front and rear side blocks 3, 4 and rotatably receives a circular rotor 5. The rotor 5 is slidably engageable with the inner peripheral surface of the cylinder 2 along a minor axis of the elliptical bore so that there are defined between the rotor 5 and the cylinder 2, two operating spaces 6a, 6b disposed in symmetric relation to one another. The rotor 5 carries thereon a plurality (five in the illustrated embodiment) of radially movable sliding vanes 7a–7e. Thus, there are five compression chambers 9a–9e defined jointly by and between the cylinder 2, front and rear side blocks 3, 4, rotor 5 and vanes 7a–7e.

The rotor 5 is firmly mounted on a shaft 10 in concentric relation thereto. The shaft 10 is rotatably supported by a pair of radial bearings 11, 12 disposed respectively on the front and rear side blocks 3, 4. A shaft seal 13 is provided between the shaft 10 and a front head 17 described later on to provide therebetween a hermetic seal for preventing leakage of a refrigeration medium. The shaft 10 has a longitudinal central groove 15 interconnecting the rear side of the compressor 1 and a shaft seal/bearing chamber 16 defined between the radial bearing 11 and the shaft seal 13 such that the refrigeration medium is supplied from the rear side into the shaft seal/bearing chamber 16 at a low pressure.

The front head 17 is firmly connected to the front side block 3 and defines jointly with the front side block 3 a high pressure chamber 18. The high pressure chamber 18 is connected with a discharge port 19 and includes a lower portion constituting an oil sump 18a for retaining therein a lubrication oil.

The oil sump 18a is held in fluid communication with an intersurface between the front side block 3 and the rotor 5 through a first oil passage 21. The first oil passage 21 has a first orifice 22 opening to the oil sump 18a so that the lubrication oil is supplied from the oil sump 18a through the first orifice 22 and the first oil passage 21 to the inner peripheral surface of the cylinder 2, thereby lubricating the vanes 7a–7e and the rotor 5.

The front side block 3 has a second oil passage 23 opening at its one end to the shaft seal/bearing chamber 16. The other end of the second oil passage 23 opens to the cylinder bore in confronting relation to an intake hole 37a. Thus a suction stroke of the compressor 1, in which the volume of the compression chamber 9a increases, will produces a negative pressure or suction tending to withdraw the refrigeration medium from the shaft seal/bearing chamber 16.

The rear side block 4 is firmly connected to a rear head 26 and defines jointly with the rear head 26 a low pressure chamber 27. The low pressure chamber 27 is connected with an intake port 28.

The low pressure chamber 27 is held in fluid communication with intake holes 37a, 37b (described later on) and an L-shaped hole 29 communicated with the longitudinal central groove 15 in the shaft 10. The rear head 26 and the rear side block 4 are recessed at their lower portions so as to define an oil sump 18b for retaining therein the lubrication oil. The oil sump 18b is connected with the oil sump 18a in the high pressure chamber 18 through a connection passage 30 extending longitudinally across the cylinder 2. With this connection passage 30, the lubrication oil in the oil sump 18b is maintained under highly pressurized condition.

The rear side block 4 has formed therein a third oil passage 32 including an orifice 33 disposed therein. The third oil passage 32 has one end opening to the oil sump 18b, the other end of this oil passage 32 opening to a bearing chamber 36 which is defined between a seal ring 34 disposed on an inner side of the radial bearing 12 and a thrust bearing 47 provided for a control plate described later on. The thus arranged third oil passage 32 and the bearing chamber 36 constitute a lubrication oil supply passage 35 through which the lubrication oil is supplied to a displacement adjustment mechanism 41 described later on.

The intake holes 37a, 37b are defined in one end face of the rear side block 4 confronting the rotor 5 and they are partly constituted by a pair of peripheral recesses 43a, 43b in the control plate 42 of the displacement adjustment mechanism 41. The control plate 42 is rotatable to change the compression starting timing, thereby varying the amount of refrigeration medium to be compressed.

The displacement adjustment mechanism 41, as shown in FIGS. 3 through 6, includes an annular recess or chamber 44 defined in the rear side block 4 for slidably receiving therein the control plate 42. The control plate 42 has a central hole 45 and the diametrically opposite peripheral recesses 43a, 43b stated above. A bushing 46 is fitted in the central hole 45 and rotatably supports thereon the shaft 10. The control plate 42 is rotatably supported on the rear side block 4 by means of the thrust bearing 47 disposed between the bushing 46 and the rear side block 4. The control plate 42 is normally biased by a torsion coil spring 48 to turn in one direction (clockwise direction in FIG. 4). The control plate 42 further includes a pair of tongue-like pressure-retaining portions 49a, 49b projecting perpendicularly from the body of the control plate 42. The pressure-retaining portions 49a, 49b are slidably received in a pair of guide grooves 50a, 50b, respectively, formed in the rear side block 4. Thus, there are two pressure chambers 51a, 51b disposed on one side of the respective pressure-retaining portions 49a, 49b and defined between the guide grooves 50a, 50b, and the control plate 42.

Figure 7:
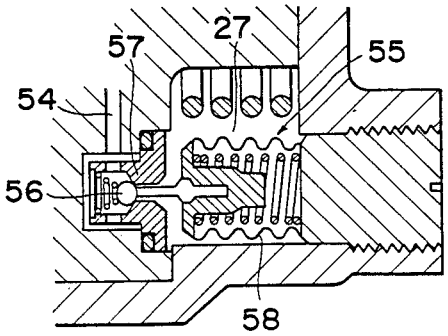
FIG. 7 is a cross-sectional view showing a control valve of the compressor.

The pressure chambers 51a, 51b communicate with each other through connection holes (not shown). One of the pressure chambers 51b is held in fluid communication with the high pressure chamber 18 via a connection hole 53, whereas the other pressure chamber 51b is communicated with the low pressure chamber 27 via a connection hole 54 in which a control valve 55 is disposed. The control valve 55 includes, as shown in FIG. 7, a bellows 58 disposed in the low pressure chamber 27 and axially deformable in response to the pressure in the low pressure chamber 27, a valve element 56 connected to one end of the bellows 58 for movement with the latter, and a valve seat 57 releasably retaining thereon the valve element 56. The control valve 55 thus constructed serves to regulate the pressure in the pressure chambers 51a, 51b in response to a change in pressure of the low pressure chamber 27.

Figure 2:
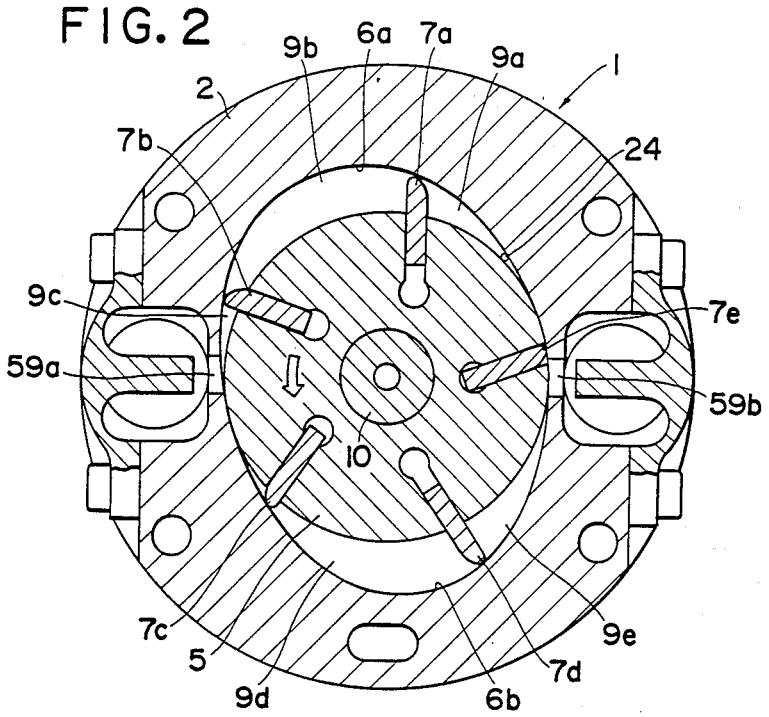
FIG. 2 is a cross-sectional view taken along line I—I of FIG. 1.
Figure 3:
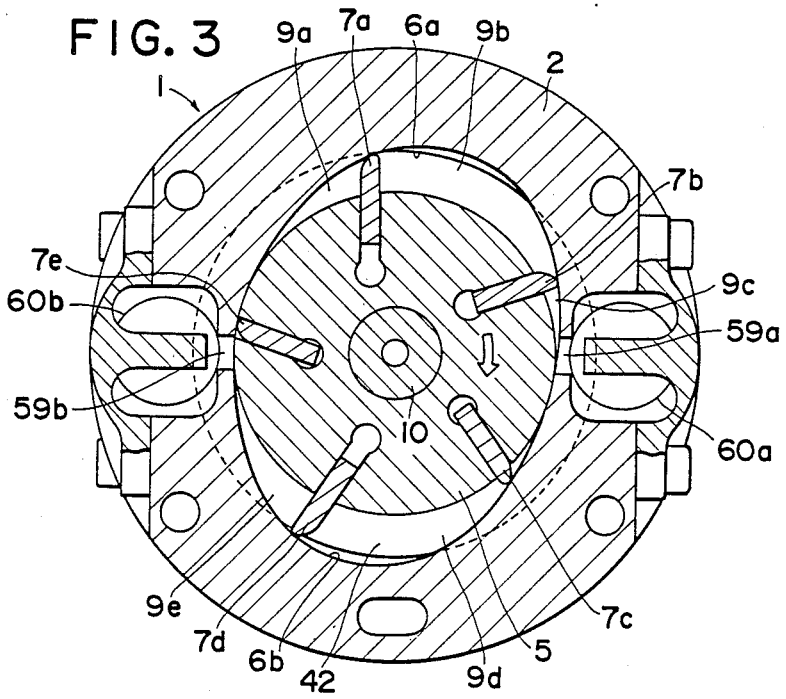
FIG. 3 is a cross-sectional view taken along line II—II of FIG. 1.
Figure 4:
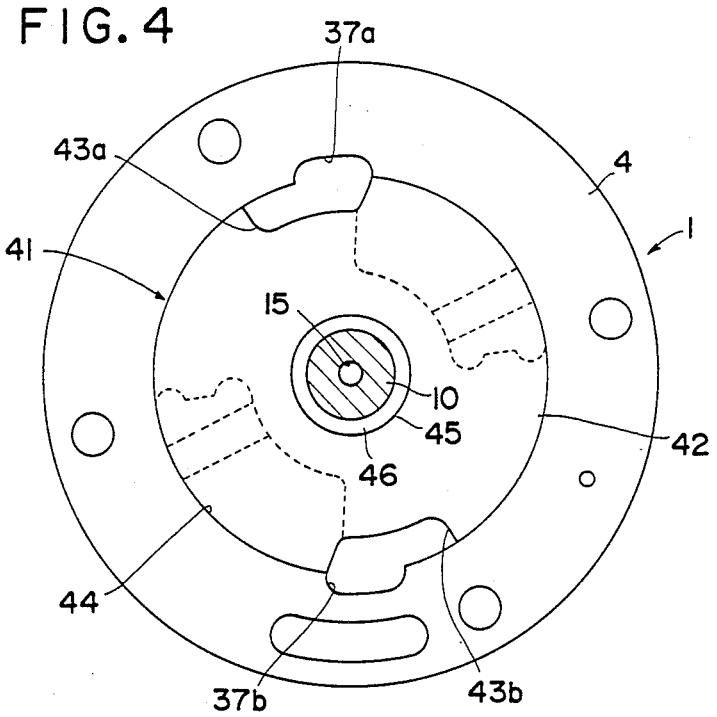
FIG. 4 is a cross-sectional view taken along line III—III of FIG. 1.
Figure 5:
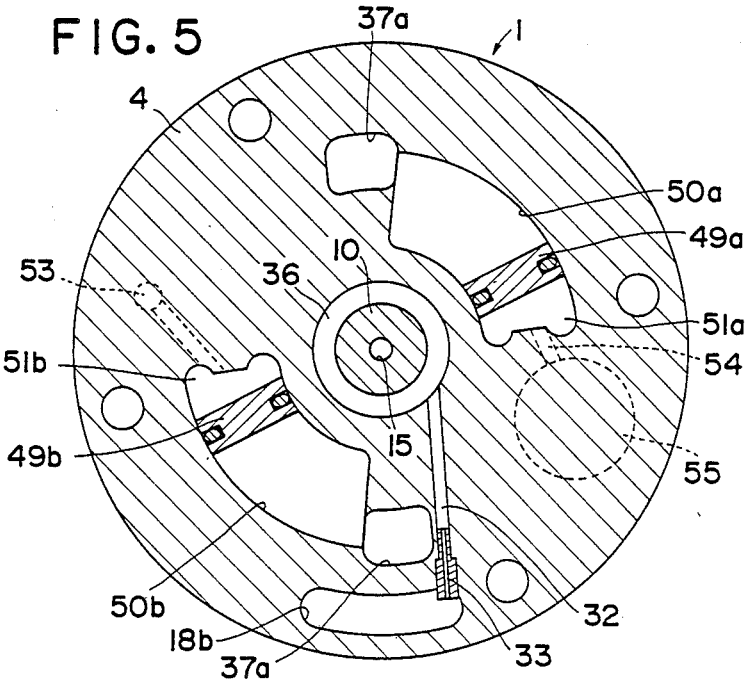
FIG. 5 is a cross-sectional view taken along line IV—IV of FIG. 1.
Figure 6:
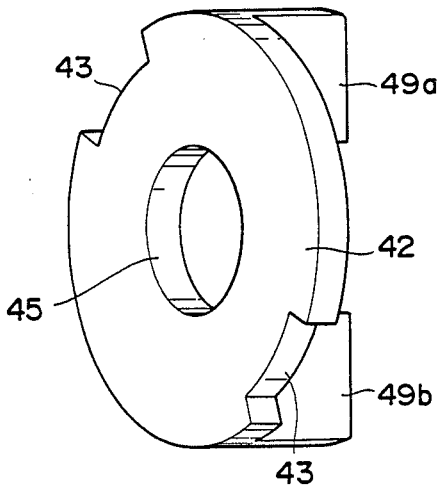
FIG. 6 is a perspective view of a control plate of a displacement adjustment mechanism incorporated in the compressor shown in FIG. 1.

As shown in FIGS. 2 and 3, the cylinder 2 further has a pair of diametrically opposite discharge holes 59a, 59b disposed adjacent to one end of each respective operating space 6a, 6b, which end is a leading end as viewed from the direction of movement of the rotor 5. Each of the discharge holes 59a, 59b is provided with a delivery valve 60a, 60b.

With this construction, when the shaft 10 is driven to rotate the rotor 5, the vanes 7a–7e slide along the inner peripheral surface of the cylinder 2 to cause the compression chambers 9a–9e to be subsequently increased and decreased in volume with each revolution of the rotor 5, whereby the refrigeration medium is compressed in the compression chambers 9a–9e and then discharged from the discharge holes 59a, 59b into the high pressure chamber 18. During that time, the amount of refrigeration medium to be supplied from the lower pressure chamber 27 to the compression chambers 9a–9e is controlled by the displacement adjustment mechanism 41 which is operative to change the compression starting timing. Thus, the displacement of the compressor 1 is variable with a change in the amount of supply of the refrigeration medium.

When a vehicle in which the compressor 1 is incorporated is cruising at low speeds, the pressure in the low pressure chamber 27 is relatively high. In this condition, the control valve 55 operates to reduce its open area, thereby limiting the flow of refrigeration medium toward the low pressure chamber 27. With this limited flow of the refrigeration medium, the pressure in the pressure chambers 51a, 51b is increased to thereby cause the control plate 42 to turn counterclockwise in FIG. 4, thus displacing the compression starting position in the counterclockwise direction. This positional displacement of the control plate 42 means that the compression starting timing at which the refrigeration medium is urged to be withdrawn into the compression chambers 9a–9e is advanced. The compressor 1 is thus driven at a large displacement mode.

Conversely, when the pressure in the low pressure chamber 27 becomes low, the control valve 55 operates to enlarge its open area, thereby increasing the amount of flow of the refrigeration medium toward the low pressure chamber 27. Under such condition, the pressure in the pressure chambers 51a, 51b is lowered whereupon the control plate 42 is turned clockwise in FIG. 4, thereby retarding the compression starting timing. With this retarded compression starting timing, the amount of refrigeration medium to be compressed in the compression chambers 9a–9e is reduced with the result that the displacement of the compressor 1 becomes small.

A description will be given to the manner in which the lubrication oil is supplied.

The radial bearings 11, 12 supporting the shaft 10 and the shaft seal 13 are lubricated by the refrigeration medium (entraining the lubrication oil) which is supplied at a low pressure from the low pressure chamber 27. The refrigeration medium flows into the radial bearing 12 successively through the hole 29 and an annular space defined between the rear side block and the shaft 10. The refrigeration medium further flows through the longitudinal central groove 15 in the shaft 10 into the shaft seal/bearing chamber 16, thereby lubricating the shaft seal 13 and the radial bearing 11 disposed in the shaft seal/bearing chamber 16. The shaft seal/bearing chamber 16 is continuously supplied with the low temperature refrigeration medium under the action of a negative pressure or suction produced by the second oil passage 23.

The front side block 3 and the rotor 5 are lubricated by the lubrication oil which is fed from the high pressure chamber 18 to the sliding surfaces of the rotor 5 and the front side block 3 via the first oil passage 21.

The rear side block 4, the rotor 5 and the displacement adjustment mechanism 41 are lubricated in such a manner that the lubrication oil is supplied at a high pressure through the lubrication oil supply passage 35 which extends from the third oil passage 32 to the thrust bearing chamber 36. After lubrication of the thrust bearing 47, the lubrication oil flows through clearances between the thrust bearing 47, the bushing 46, the shaft 10 and the control plate 42 to the side face of the rotor 5, thereby lubricating all the components stated above.

The refrigeration medium entraining the lubrication oil and the lubrication oil which have been supplied for lubrication are recovered at the high pressure chamber 18. A slight amount of the lubrication oil may flow out from the compressor 1 into a refrigeration system.

Obviously, various modifications and variations of the present invention are possible in the light of the above teaching. It is therefore to be understood that within the scope of the appended claims the invention may be practiced otherwise than as specifically described.

What is claimed is:

1. A variable displacement compressor, comprising:

a compressor cylinder having opposite sides;

a pair of side blocks, one said side block connected to each opposite side of said compressor cylinder to thereby define a cylinder chamber inside said compressor cylinder;

a rotor, rotatably disposed in said cylinder chamber, having thereon a plurality of radially movable sliding vanes;

said compressor cylinder, said rotor, said side blocks and said plurality of vanes together defining a plurality of variable volume compression chambers varying in volume with rotation of said rotor in said cylinder chamber;

a pair of heads, one said head attached to a respective said side block;

displacement adjustment means incorporated in a first said side block and its respective head for controlling the compression starting timing in said plurality of compression chambers;

said first side block having a first oil sump for retaining therein a lubricating oil;

a second oil sump for retaining oil therein exposed to a high pressure output of said compression chambers;

a connection passage in said compressor cylinder connecting said first and second oil sumps to thereby maintain said oil in said first oil sump under a high pressure;

a shaft supporting said rotor, said shaft having a first end supported by said first side block;

said first side block having a bearing chamber therein extending circumferentially about the outer peripheral surface of said shaft;

a lubrication oil supply passage means in said first side block connecting said first oil sump with said displacement adjustment means, said lubrication oil supply passage means comprising said bearing chamber and an oil passage in said first side block interconnecting said first oil sump and said bearing chamber.

2. A variable displacement compressor comprising:

a compressor cylinder;

a first side block connected to one side of said compressor cylinder and a second side block connected to an opposite side of said cylinder;

a rotor having a plurality of radially movable sliding vanes rotatably disposed in said cylinder;

said compressor cylinder, said rotor, said side blocks and said plurality of vanes together defining a plurality of variable volume compression chambers varying in volume with rotation of said rotor in said cylinder;

a first head attached to said first side block, said first head and said first sideblock together defining an intake passage for receiving and delivering low pressure fluid to said plurality of variable volume compression chambers;

a second head attached to said second sideblock, said second head and said second sideblock together defining an output passage for receiving and delivering high pressure fluid from said variable volume compression chambers;

displacement adjustment means in said first side block for controlling the compression starting timing in said plurality of variable volume compression chambers;

a first oil sump in said first side block for retaining therein a lubricating oil;

a second oil sump in said second side block for retaining therein lubricating oil, said second oil sump in direct fluid communication with said output passage to thereby pressurize lubricating oil in said second oil sump with high pressure fluid from said output passage;

a connection passage in said compressor cylinder connecting said first and second oil sumps to thereby pressurize lubricating oil in both said oil sumps; and a lubrication oil supply passage means in said first side block connecting said first oil sump with said displacement adjustment means to thereby lubricate said displacement adjustment means.

3. The variable displacement compressor as set forth in claim 2, wherein:

a shaft is mounted between said side blocks through said compressor cylinder, said shaft supporting said rotor; and said displacement adjustment means in said first side block surrounds said shaft and is adjacent said rotor.

4. The variable displacement compressor as set forth in claim 3, wherein:

said lubrication oil supply passage means comprises a bearing chamber in said first side block surrounding said shaft and an oil passage interconnecting said bearing chamber said first oil sump.

* * * * *